US006523740B2

(12) United States Patent
Campbell

(10) Patent No.: US 6,523,740 B2
(45) Date of Patent: Feb. 25, 2003

(54) FLORAL CONTAINER

(76) Inventor: Ronald C. Campbell, 196 Putnam Hill Rd., Sutton, MA (US) 01590

( * ) Notice: Subject to any disclaimer, the term of this patent is extended or adjusted under 35 U.S.C. 154(b) by 0 days.

(21) Appl. No.: 09/850,050

(22) Filed: May 7, 2001

(65) Prior Publication Data

US 2002/0162882 A1 Nov. 7, 2002

(51) Int. Cl.[7] ..... B65D 5/10; B65D 85/52

(52) U.S. Cl. ..... 229/114; 206/423; 47/84; 229/149; 229/150; 229/162

(58) Field of Search ..... 229/113, 114, 229/148, 149, 150, 155, 162, 185; 206/423; 47/84; D9/418, 431

(56) References Cited

U.S. PATENT DOCUMENTS

| | | | | | |
|---|---|---|---|---|---|
| 1,616,983 | A | * | 2/1927 | O'Brien et al. | 229/114 |
| 2,345,646 | A | * | 4/1944 | Williamson | 229/113 |
| 2,540,707 | A | * | 2/1951 | Beukelman | 206/423 |
| 2,702,154 | A | * | 2/1955 | Linson | 229/114 |
| 2,767,831 | A | * | 10/1956 | Brecht | 47/84 |
| 2,875,943 | A | * | 3/1959 | Cooper | 229/114 |
| 3,035,751 | A | * | 5/1962 | Brown | 229/150 |
| 3,547,336 | A | * | 12/1970 | Jacke | 229/114 |
| 3,809,310 | A | * | 5/1974 | VanderLugt, Jr. | 229/155 |
| 4,003,515 | A | * | 1/1977 | Steele | 229/185 |
| 4,083,487 | A | * | 4/1978 | Zattoni | 229/150 |
| 4,230,261 | A | * | 10/1980 | Austin | 229/114 |
| 4,230,729 | A | * | 10/1980 | Hoelzel, Jr. | 229/162 |
| 4,948,035 | A | * | 8/1990 | Wischoff | 229/185 |
| D406,234 | S | * | 3/1999 | Metter et al. | D9/431 |

FOREIGN PATENT DOCUMENTS

| | | | | |
|---|---|---|---|---|
| JP | 4/128128 A | * | 4/1992 | 229/162 |

* cited by examiner

*Primary Examiner*—Gary E. Elkins
(74) *Attorney, Agent, or Firm*—Blodgett & Blodgett, P.C.

(57) ABSTRACT

A floral container which is tapered from a relatively large horizontal cross-section at the upper end of the container to a relatively small horizontal cross-section at the lower end of the container. The container has a pair of forward walls, a pair of rearward walls, and a bottom wall. At least one of the forward walls has a transparent portion adjacent the upper end of the container which constitutes a viewing window for the contents of the container.

7 Claims, 21 Drawing Sheets

FLORAL CONTAINER

STATEMENT REGARDING FEDERALLY SPONSORED RESEARCH OR DEVELOPMENT

This invention has been created without the sponsorship or funding of any federally sponsored research or development program.

CROSS-REFERENCE TO RELATED APPLICATIONS

NOT APPLICABLE

BACKGROUND OF THE INVENTION

The present invention is directed generally to a container for holding a bouquet of flowers and, specifically, to a container for holding and protecting a bouquet of cut flowers.

The primary types of packaging for cut flowers in current use are: two-piece paperboard boxes, clear plastic boxes of a one piece clam shell design, paper sleeves and plastic sleeves.

The two piece paperboard boxes require significant time and effort to assemble and are cumbersome to handle. Stores have limited storage space to make pre-assembled boxes available to customers.

Boxes which are made of clear plastic do not have the structural strength to hold large cut flower bunches. The lid fastening features are not dependable for holding the lid cover in place.

Sleeves which are made of clear plastic do not offer much protection against the elements and do not protect the flowers from being crushed as the flowers are transported. All sleeves are subject to being punctured by the free ends of the stems.

None of the prior art flower boxes and sleeves offer adequate protection against leaking from moisture emanating from the flower bunch or bouquet. Also, none of the prior art boxes and sleeves enable the natural attractiveness of a bouquet or bunch of cut flowers to be displayed with maximum effect. These and other difficulties experienced with the prior art floral boxes and sleeves have been obviated by the present invention.

It is, therefore, a principal object of the invention to provide a floral container which brings out the natural attractiveness of a bouquet of cut flowers.

A further object of the present invention is the provision of a floral container which provides enhanced protection to a bouquet of cut flowers against crushing.

Another object of the invention is to provide a floral container which provides protection against leaking from moisture generated within the container.

A still further object is to provide a floral container which has superior resistance to damage by the stems of a bouquet of cut flowers.

Still another object of the invention is the provision of a floral container that is easy to assemble and secure against accidental opening.

Another object of the invention is to provide a floral container which provides ventilation at the upper end of the container to allow for air circulation within the container and prolong the life of flowers therein.

With these and other objects of the invention in view, as will be apparent to those skilled in the art, the invention resides in the combination of parts set forth in the specification and covered by the claims appended hereto.

BRIEF SUMMARY OF THE INVENTION

In general, the invention consists of a floral container which is tapered from a relatively large horizontal cross-section at the upper end of the container to a relatively small horizontal cross-section at the lower end of the container. The container has a pair of forward walls, a pair of rearward walls, and a bottom wall. At least one of the forward walls has a transparent portion adjacent the upper end of the container which constitutes a viewing window for the contents of the container.

BRIEF DESCRIPTION OF THE DRAWINGS

The character of the invention, however, may be best understood by reference to one of its structural forms, as illustrated by the accompanying drawings, in which.

DETAILED DESCRIPTION OF THE INVENTION

Figure 1:
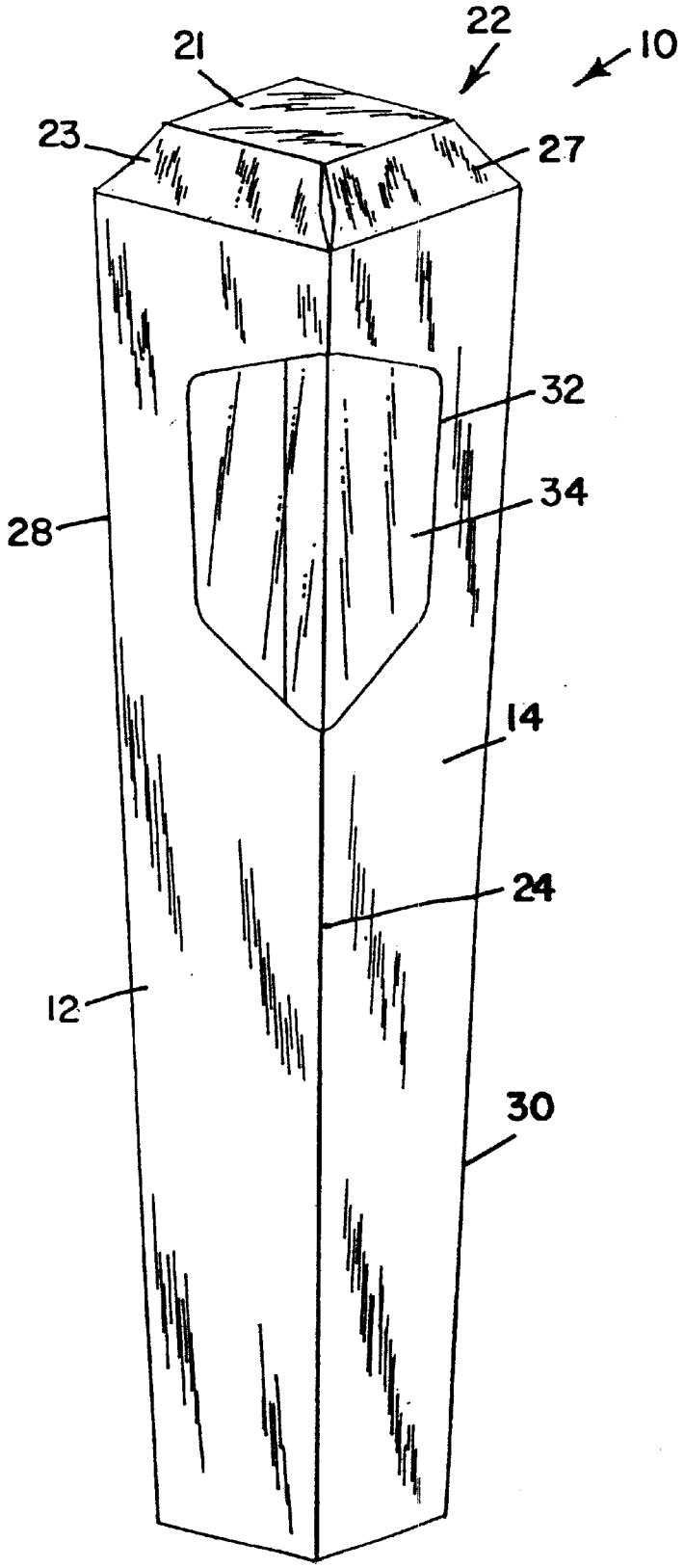
FIG. 1 is an isometric view of a floral container embodying the principles of the present invention.
Figure 2:
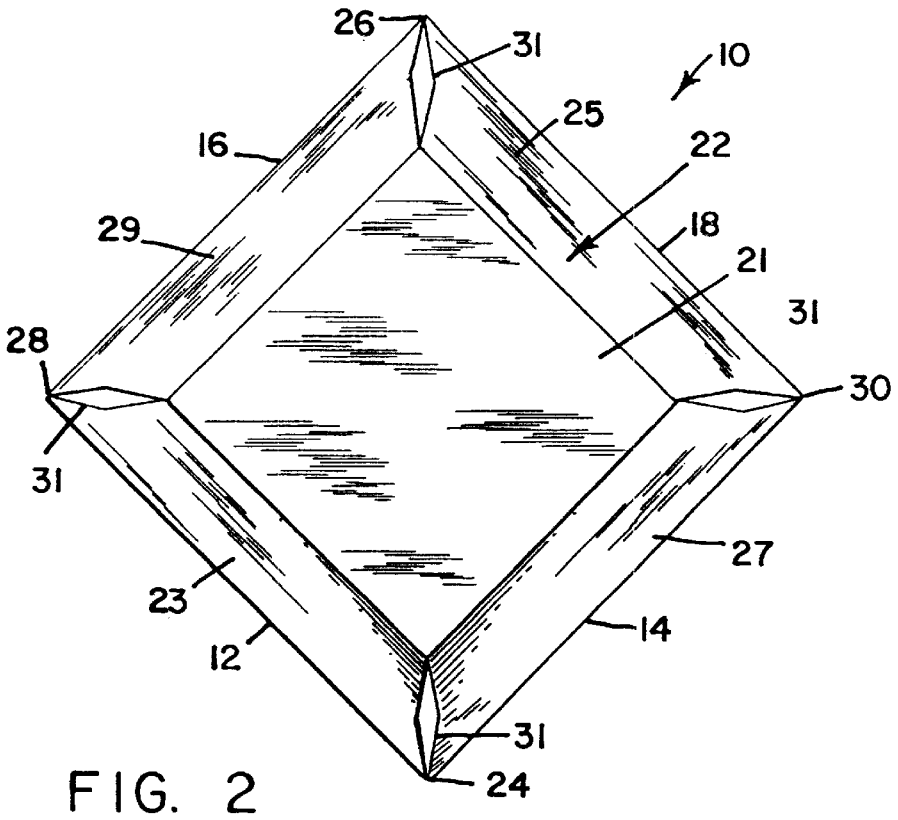
FIG. 2 is a top plan view of the floral container.
Figure 3:
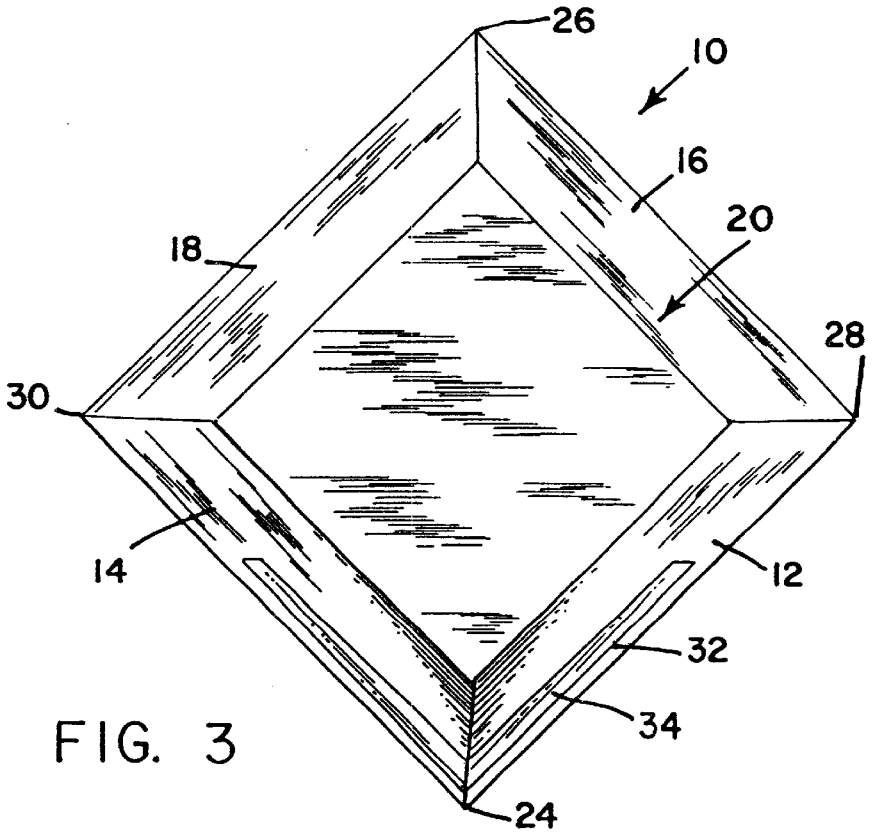
FIG. 3 is a bottom plan view of the floral container.
Figure 4:
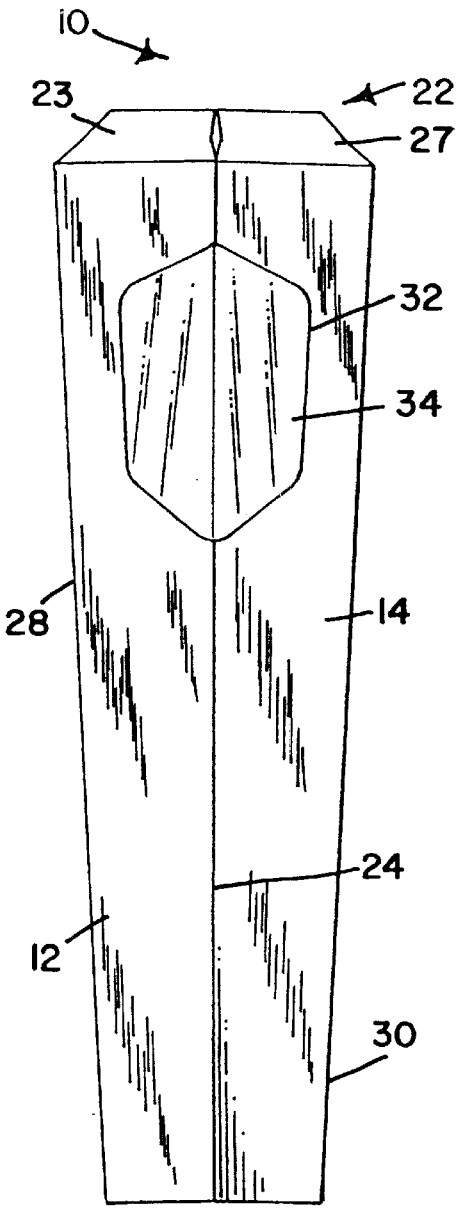
FIG. 4 is a front elevational view of the floral container.
Figure 5:
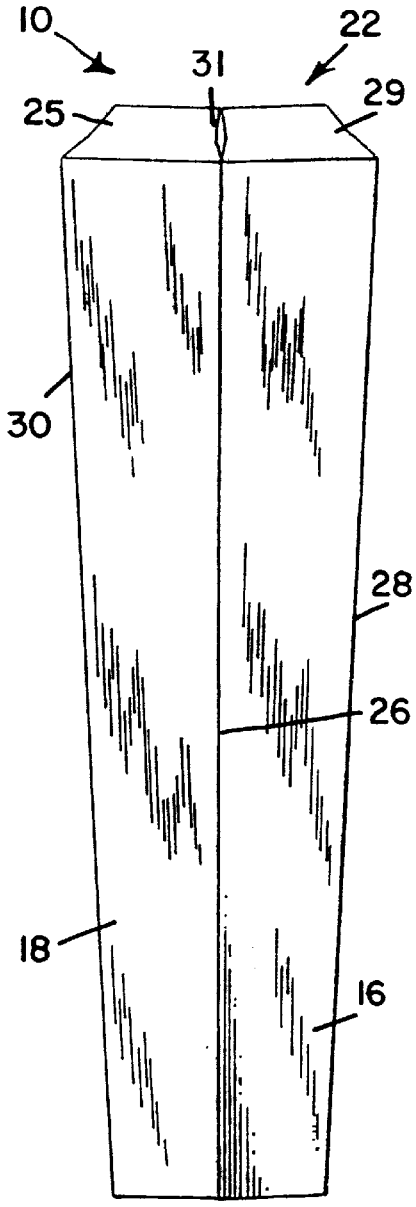
FIG. 5 is a rear elevational view of the floral container.
Figure 6:
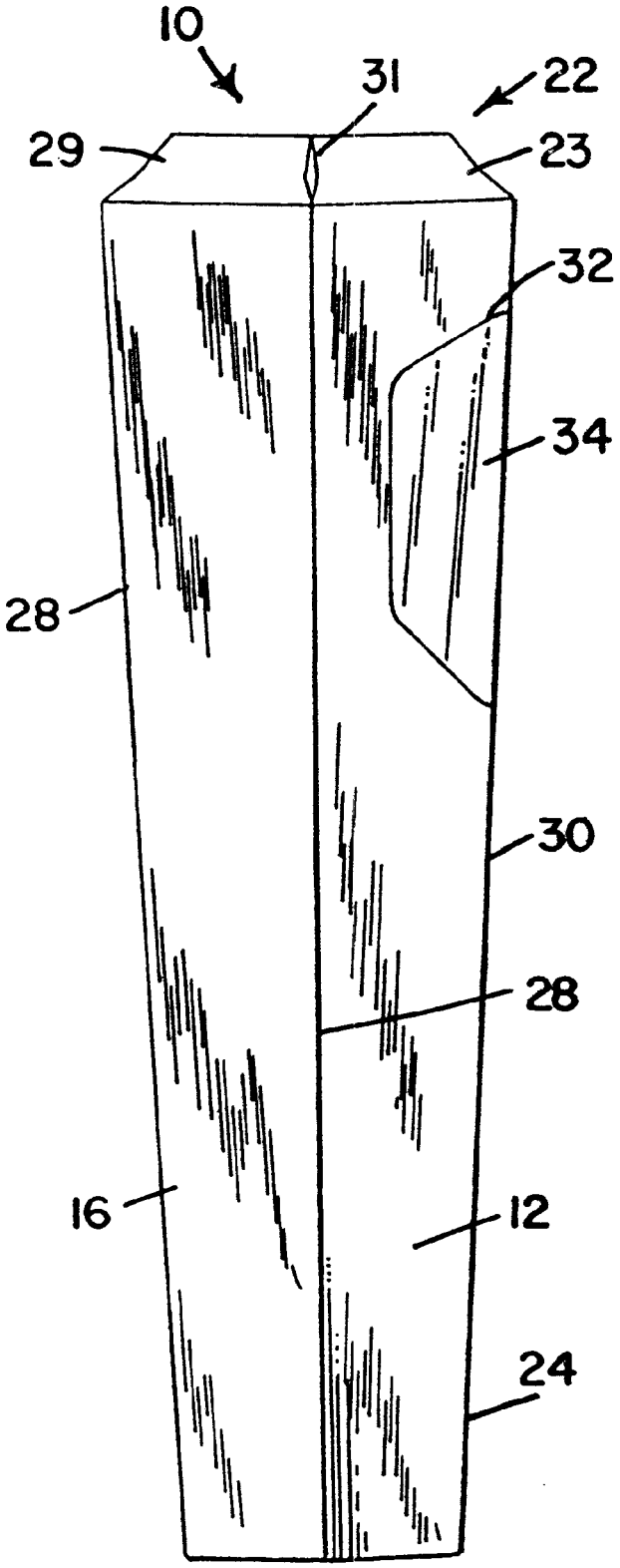
FIG. 6 is a left side elevational view of the floral container.

Referring to FIGS. 1–6 there is shown a floral container embodying the principle of the present invention, generally indicated by the reference numeral 10. Floral container 10 is an elongated four sided box that tapers from a relatively large cross-section at the top to a relatively small cross-section at the bottom. Container 10 has a left forward wall 12, a right forward wall 14, a left rearward wall 16, and a right rearward wall 18. The bottom edges of the walls 12, 14, 16, and 18 define a bottom opening which is closed by a bottom wall 20. The upper edges of the walls 12, 14, 16, and 18 define a top opening which is closed by an openable top closure, generally indicated by the reference numeral 22.

The openable top closure 22 includes a horizontal square upper portion 21 which is vertically spaced from the upper edges of the side walls 12, 14, 16, and 18 and four lower portions which extend from the outer edges of the upper portion 21 to the upper edges of the side walls 12, 14, 16, and 18. The lower portions of the top closure 22 include a first lower portion 23, a second lower portion 25, a third lower portion 27, and a fourth lower portion 29. A vent opening 31 is formed at each corner of the container between adjacent ends of the lower portions.

The container 10 includes a forward vertical edge 24 at the juncture of the left forward wall 12 and the right forward wall 14. A rearward vertical edge 26 is formed at the juncture of the left rearward wall 16 and the right rearward wall 18. A left vertical edge 28 is formed at the juncture of the left rearward wall 16 and the left forward wall 12. A right vertical edge 30 is formed at the juncture of the right rearward wall 18 and the right forward wall 14. An opening 32 is formed in the front walls 12 and 14 at the upper end of the front edge 24. The aperture 32 is covered by a sheet 34 of transparent material, such as clear cellulose acetate film.

Figure 7:
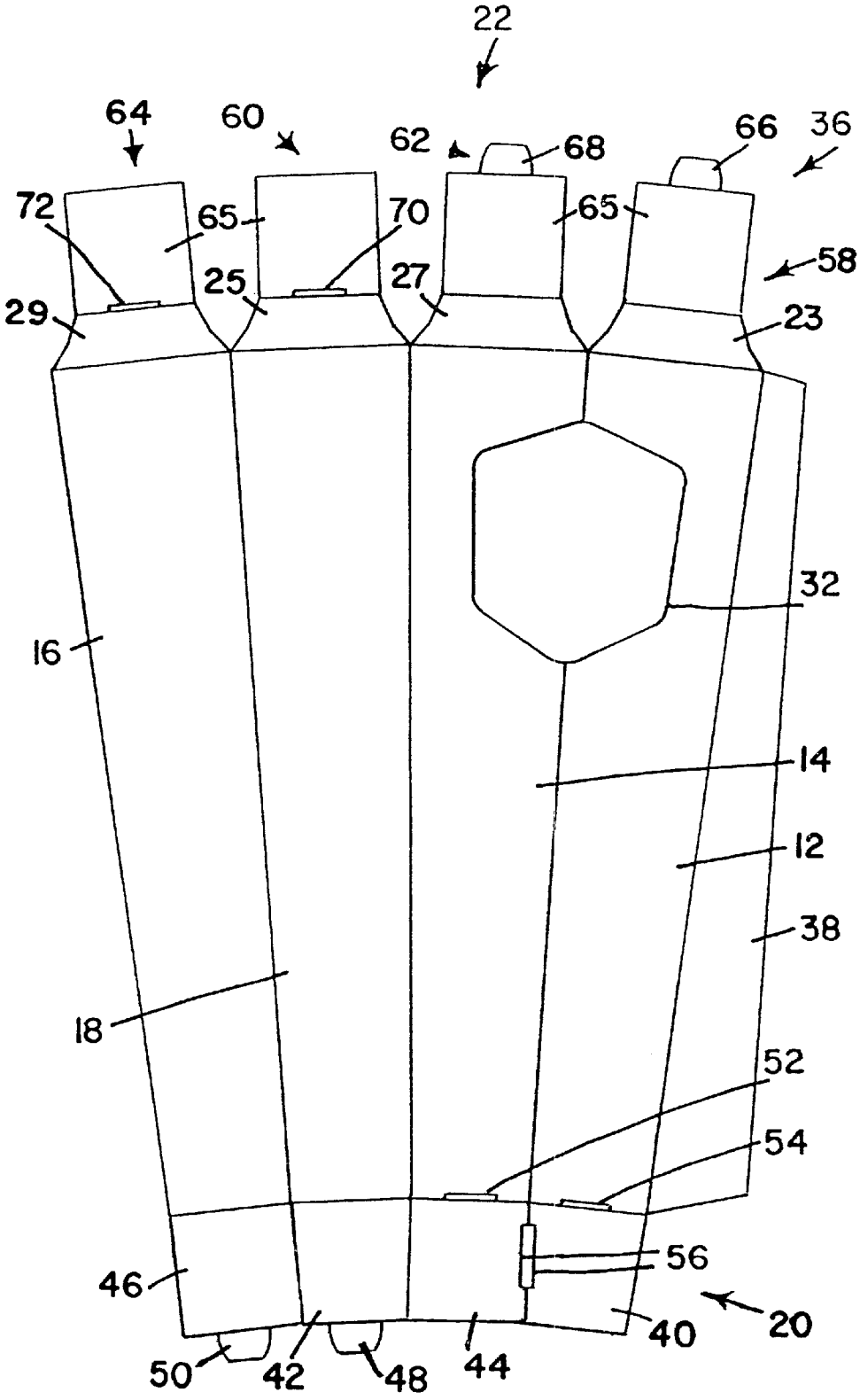
FIG. 7 is a diagram of a blank from which the floral container of FIG. 1 is formed and including an opening.

Referring to FIG. 7, there is a shown a blank 36 from which the floral container 10 is assembled. The blank 36 is cut from a sheet of stiff paper board, i.e., fine quality freezer-paper board material. The blank 36 includes a glue flap 38 at one end of the blank and the side walls 12, 14, 16, and 18. The aperture 32 is formed in the walls 12 and 14 when the blank is formed. A first lower flap 40 is hingedly connected to the bottom edge of side wall 12. A second lower flap 42 is hingedly connected to the bottom edge of the side wall 18. A third lower flap 44 is hingedly connected to the bottom edge of side wall 14. A fourth lower flap 46 is hingedly connected to the bottom edge of the side wall 16. A first locking tab 48 is hingedly connected to the bottom edge of the second flap 42. A second locking tab 50 is hingedly connected to the bottom edge of the fourth flap 46. The abutting edges of flaps 44 and 40 each have a recess 56. A first slot 52 is located at the bottom edge of wall 12. A second slot 54 is located at the bottom edge of the wall 14.

The openable top closure 22 is formed from a first upper flap, generally indicated by the reference numeral 58, a second upper flap, generally indicated by the reference numeral 60, a third upper flap, generally indicated by the reference numeral 62, and a fourth upper flap, generally indicated by the reference numeral 64. Each of the flaps 58, 60, 62, and 64 includes a square outer portion 65 and an inner portion which is hingedly connected to a corresponding one of side walls 12, 14, 16, and 18. The inner portions of flaps 58, 60, 62, and 64 constitute the lower portions 23, 25, 27, and 29, respectively, of the top closure 22. The outer portion 65 of each upper flap is hingedly connected to its respective inner portion. A first tab 66 is hingedly connected to the outer end of the first upper flap 58. A second tab 68 is hingedly connected to the outer end of the third upper flap 62. When the blanks 36 is formed, crease lines are pressed into the blank to define the vertical edges and side walls of the container and to define the top and bottom edges of the walls 12, 14, 16, and 18 and the upper and lower portions of each of the upper flaps. A crease line is pressed into the blank at the base of each of the tabs 48, 50, 66, and 68. A first slot 70 is located at the juncture between the outer and inner portions of the second upper flap 60. A second slot 72 is located at the juncture between the outer and inner portions of the fourth upper flap 64. Blank 36 is assembled into container 10 by having the interior surface of the blank facing upwardly as depicted in FIG. 7

Figure 8:
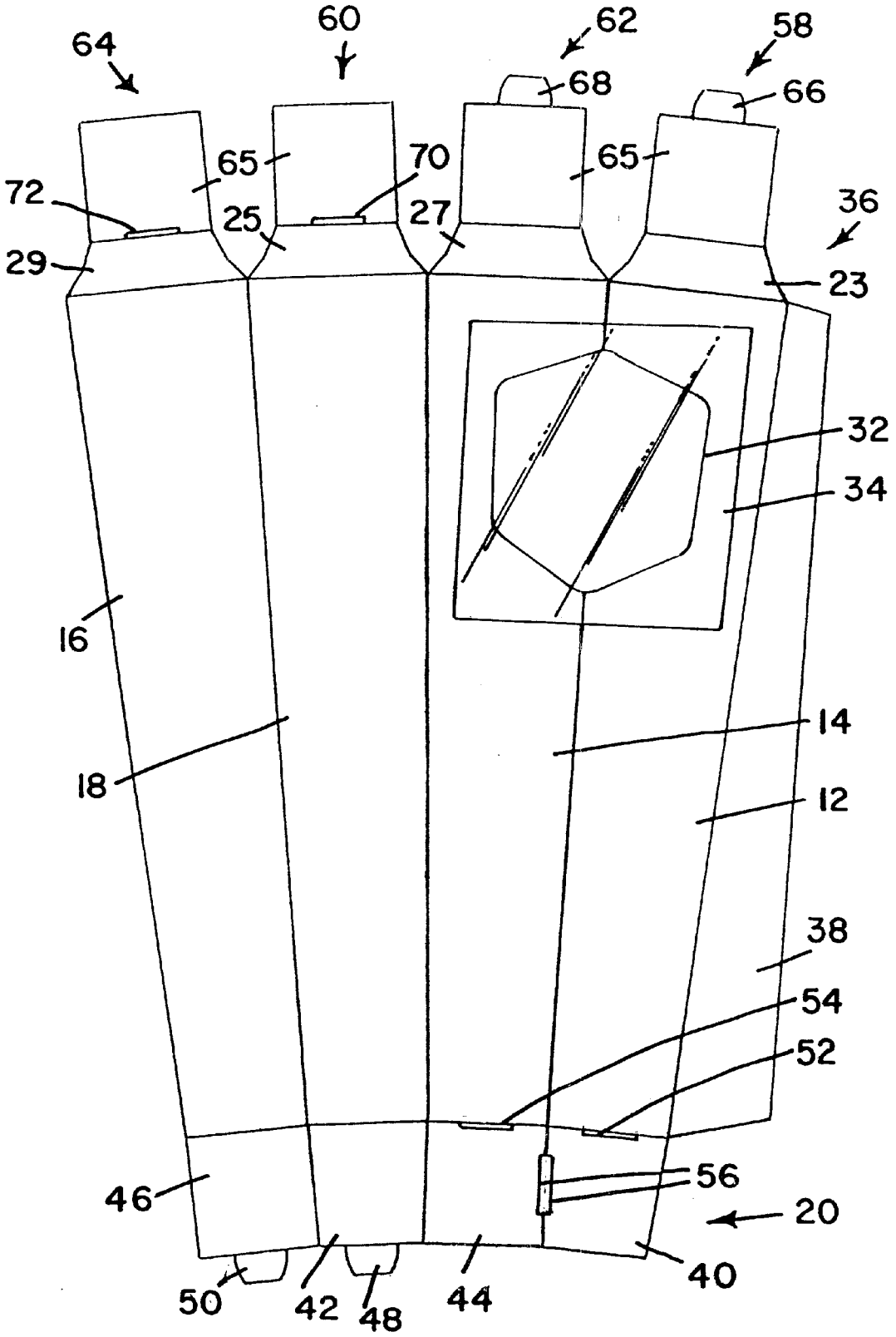
FIG. 8 is a view similar to FIG. 7, showing the opening covered by a sheet of transparent material.

Referring to FIG. 8, the first step in assembling the container 10 is to fix the sheet of clear film 34 onto the inner surfaces of walls 12 and 14, i.e., by gluing so that sheet 34 completely covers the aperture 32.

The glue flap 38 is tapered from a relatively large width at the lower end of the container to a relatively small width at the upper end of the container. The shape of the glue flap maximizes the contact surfaces between the glue flaps and the side wall 12 without reducing the size of the window opening 32. This provides maximum bonding of the side ends of the blank. The tapered shape of the glue flap 38 also positions the outer side edge of the glue flap at an optimum angle relative to the rest of the blank 58 that when used on existing blank processing machinery helps to maintain the blank in a proper orientation on the machinery in the assembly steps of applying the sheet of film over the opening 32.

Figure 9:
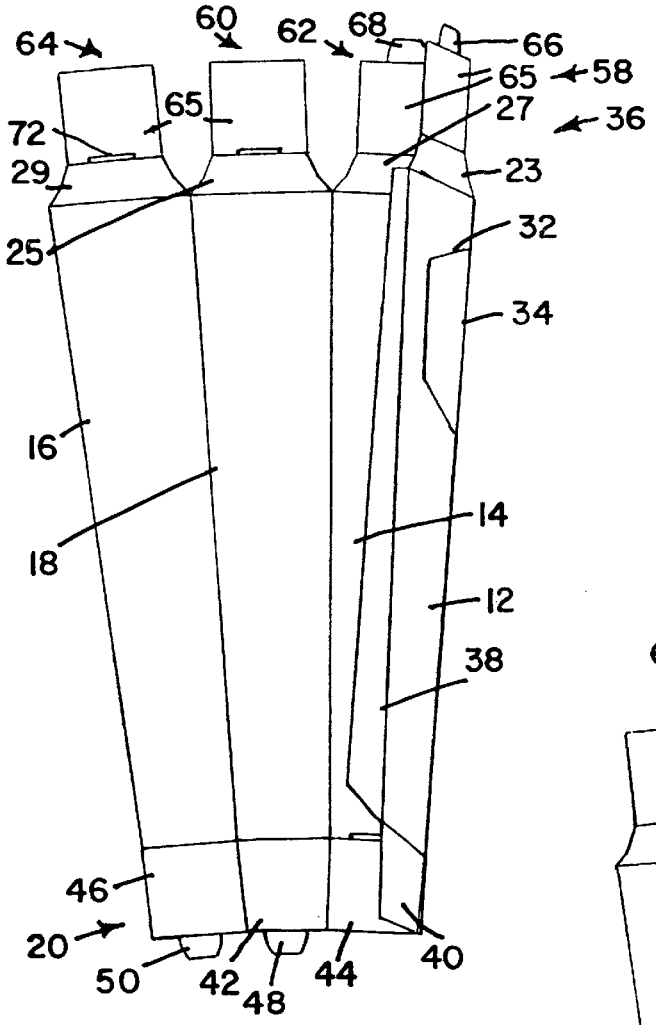
FIGS. 9–12 are operational views showing how the blank of FIG. 7 is folded to form a tubular structure.
Figure 10:
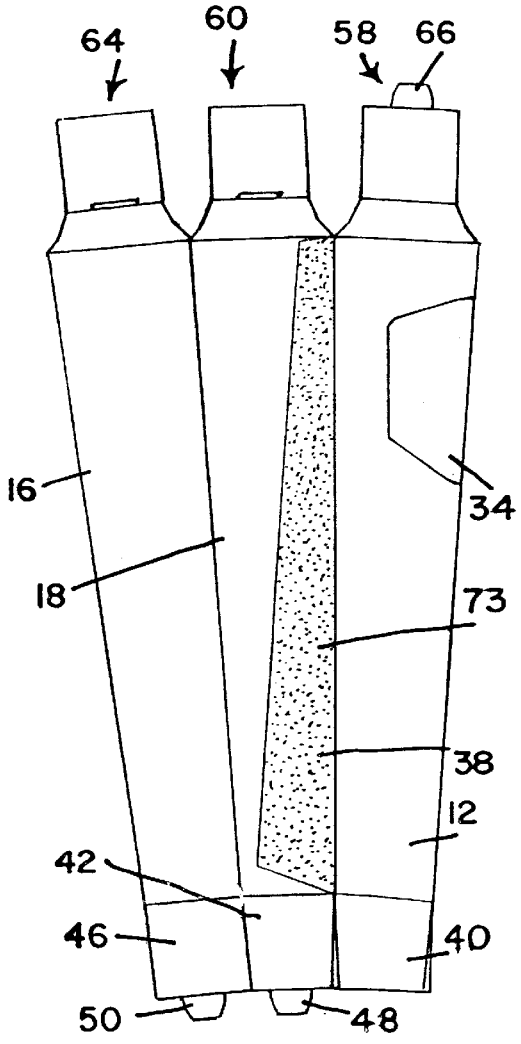

Referring to FIGS. 9 and 10, the blank 36 is folded along the crease line which divides the walls 12 and 14 so that wall 12 overlaps wall 14, as shown in FIG. 10. Glue, generally indicated by the reference numeral 73, is applied to the outer surface of the glue flap 38 as illustrated in FIG. 10.

Figure 11:
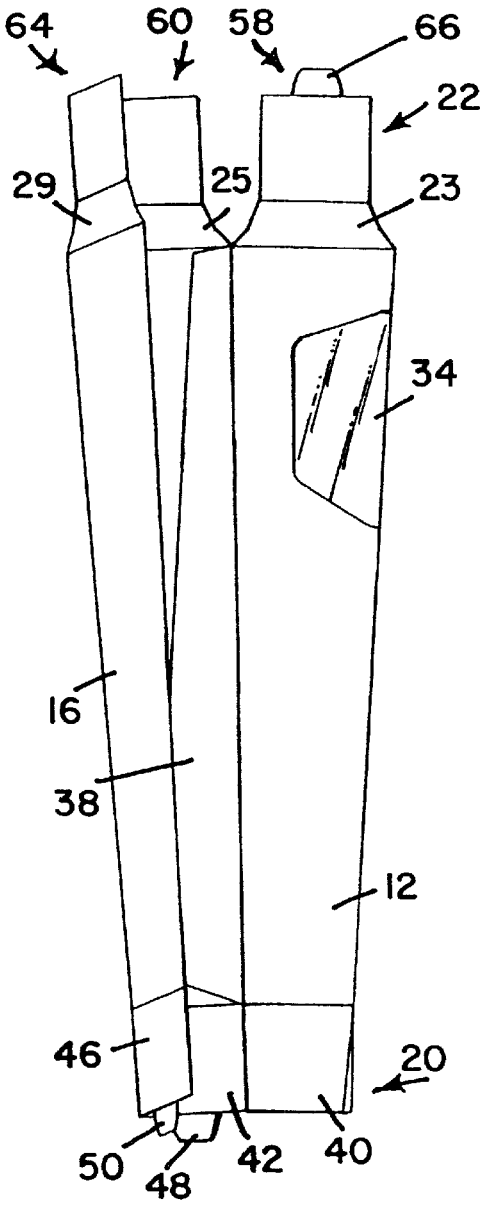
Figure 12:
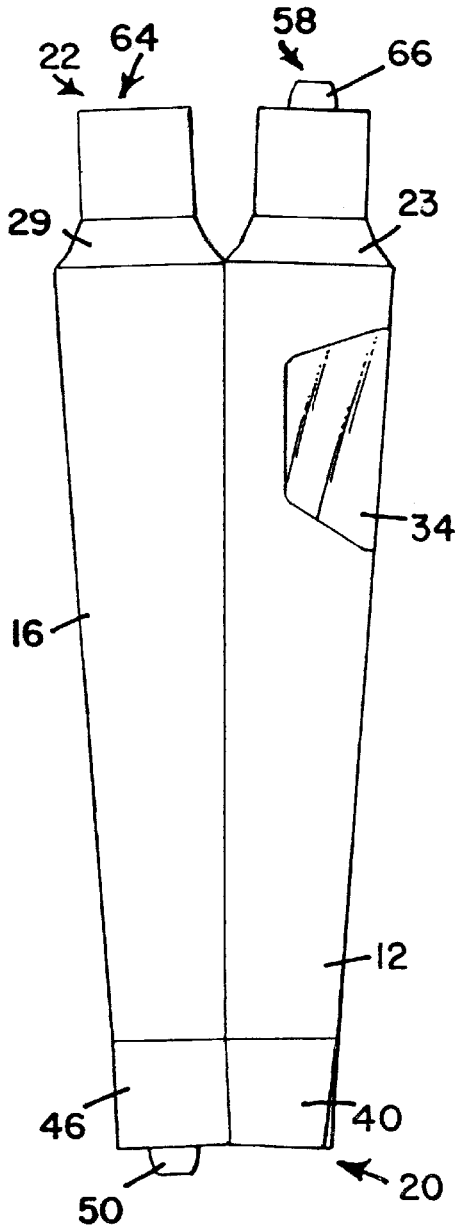

Referring to FIGS. 11 and 12, the blank 36 is folded along the seam line dividing walls 16 and 18 so that wall 16 overlies wall 18 as shown in FIG. 12. This also places the inner surface of wall 16 on top of the glued side of the glue flap 38 to fix the wall 16 to the glue flap. This completes the formation of the container 10 in its flat collapsed state as shown on FIG. 12. This is the most efficient state for storing and shipping the container prior to final assembly into a usable floral container.

Figure 13:
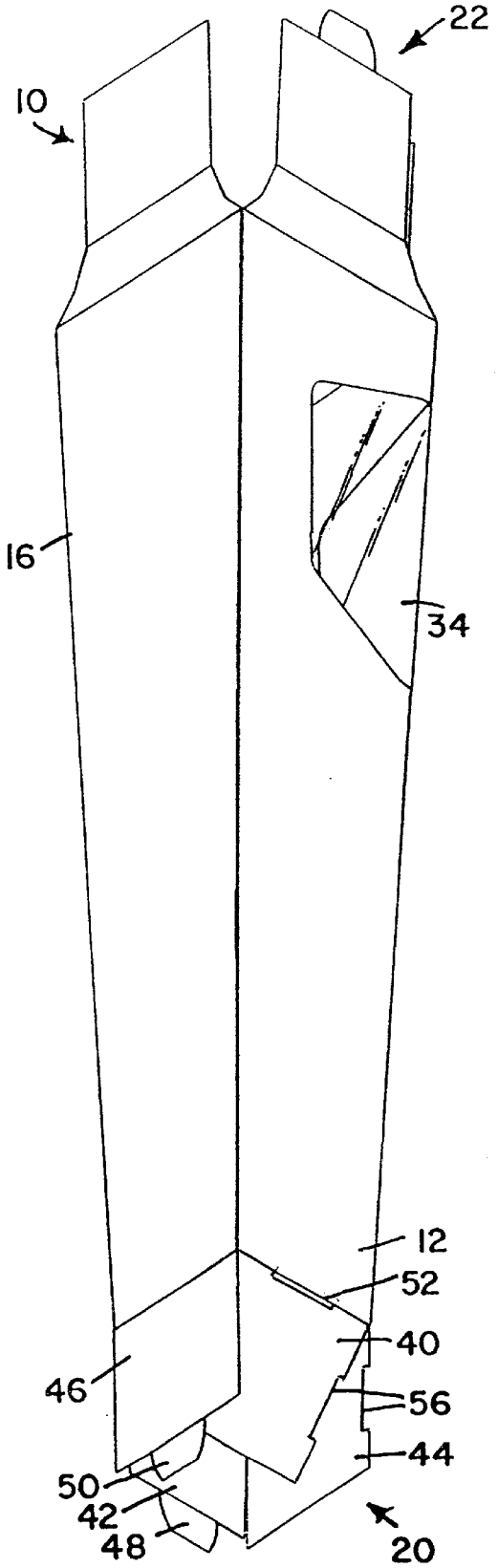
FIGS. 13–22 are operational views showing how the bottom flaps are folded to form the bottom wall of the container.
Figure 14:
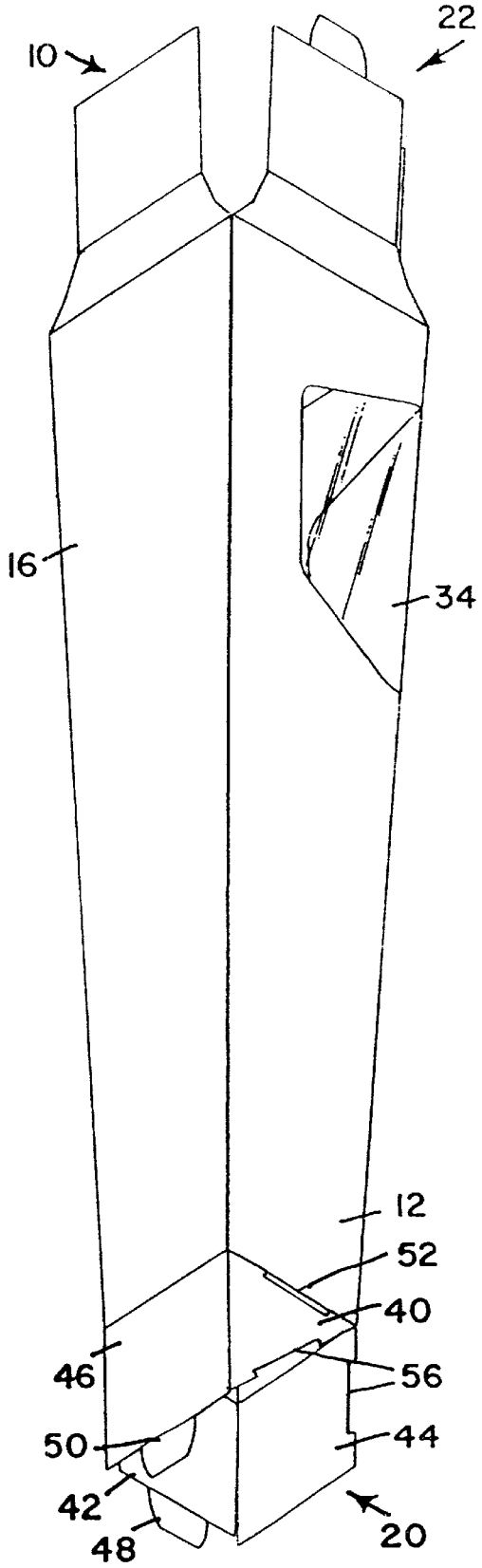
Figure 15:
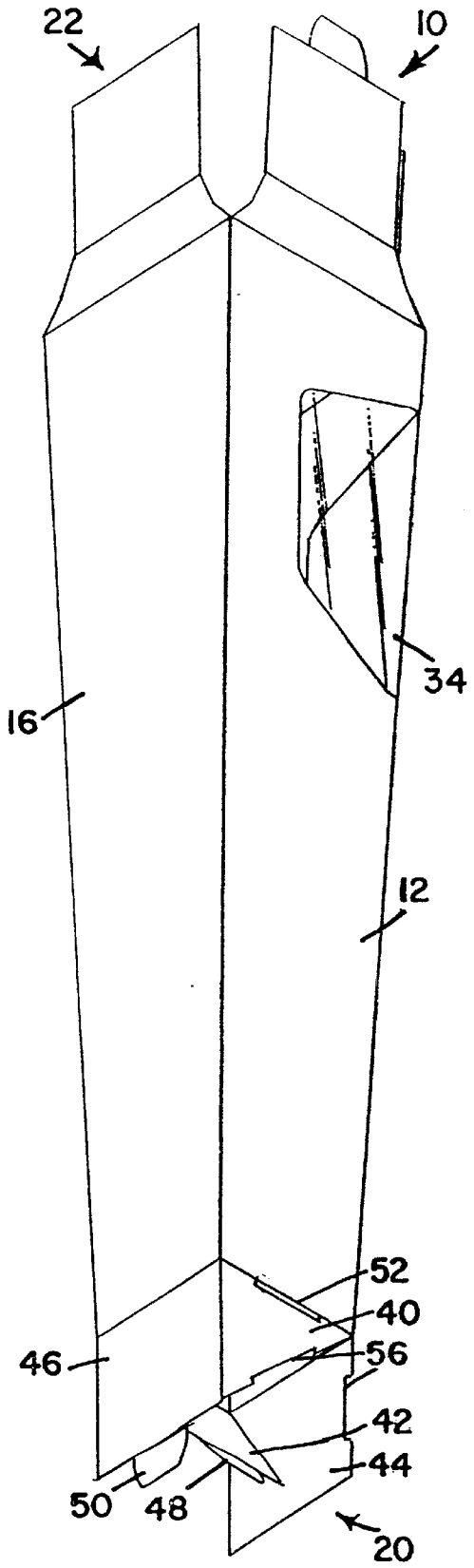
Figure 16:
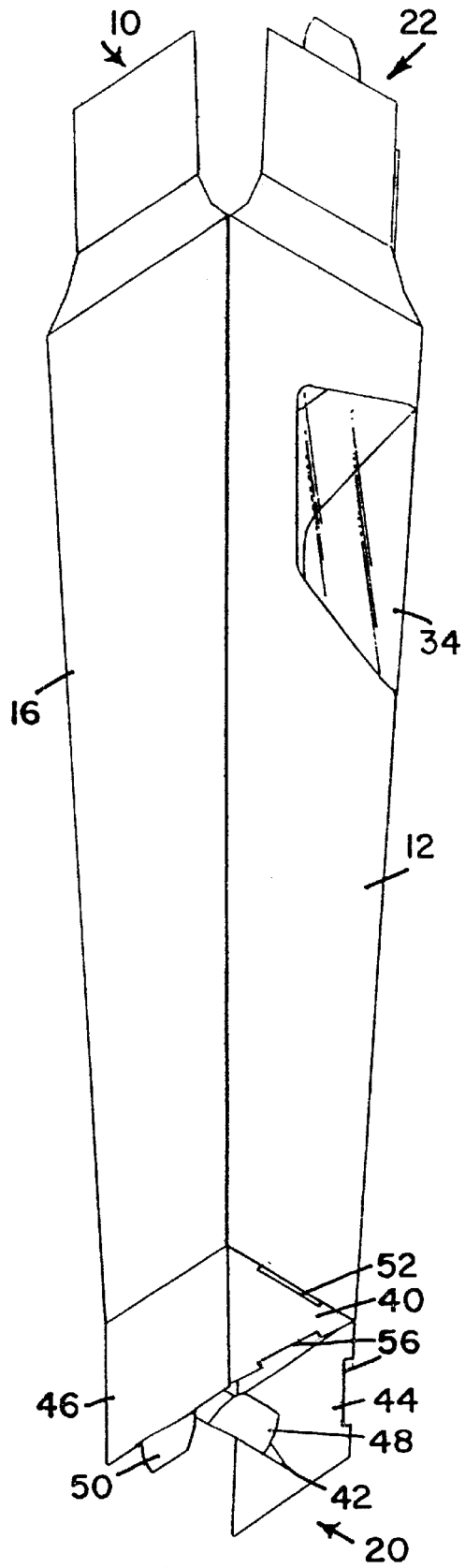
Figure 17:
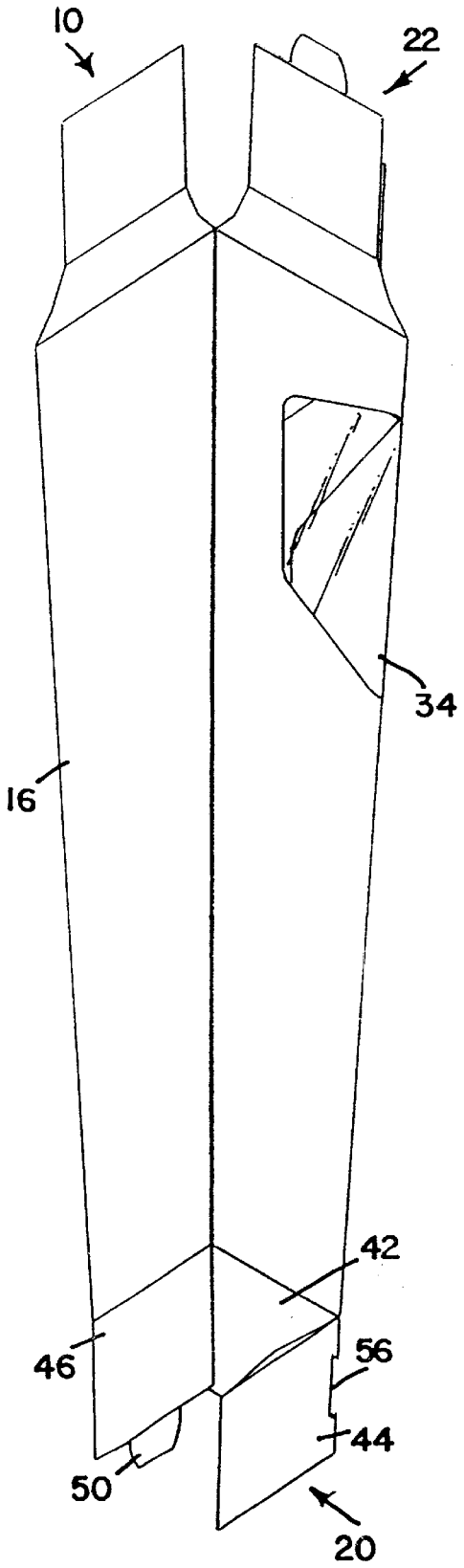

The flattened container shown in FIG. 12 is formed into its final usable state by applying pressure to the vertical edges 24 and 26, as in container 10, to force the container into its open state as shown in FIGS. 13 and 14. The bottom wall 20 is formed by first folding the flap 40 inwardly as shown in FIGS. 13 and 14. The flap 42 is then folded inwardly as shown in FIG. 15 and the tab 48 is folded inwardly at a 90° angle relative to the flap 48 as shown in FIG. 16. Tab 48 is inserted into the first slot 52 so that the flap 40 lies beneath the flap 42 as shown in FIG. 17.

Figure 18:
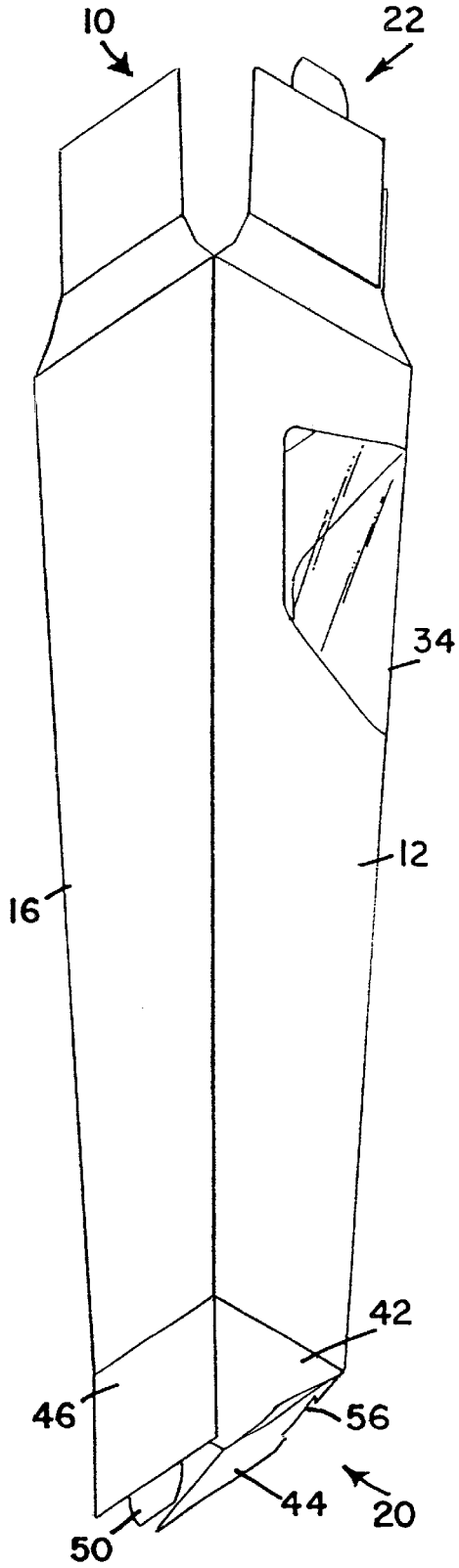
Figure 19:
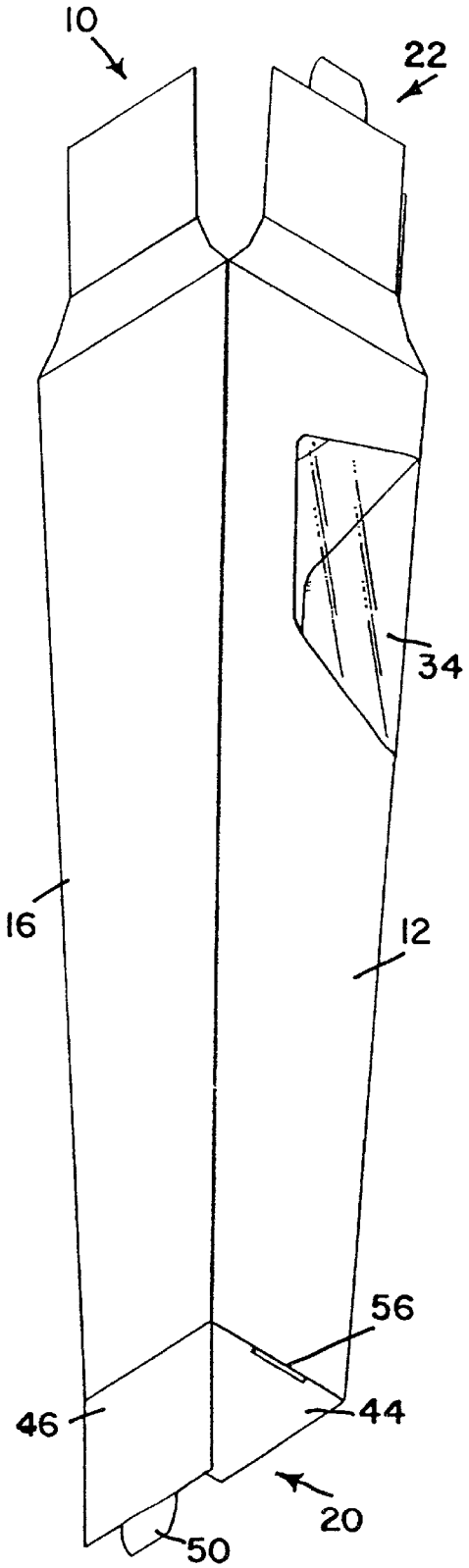
Figure 20:
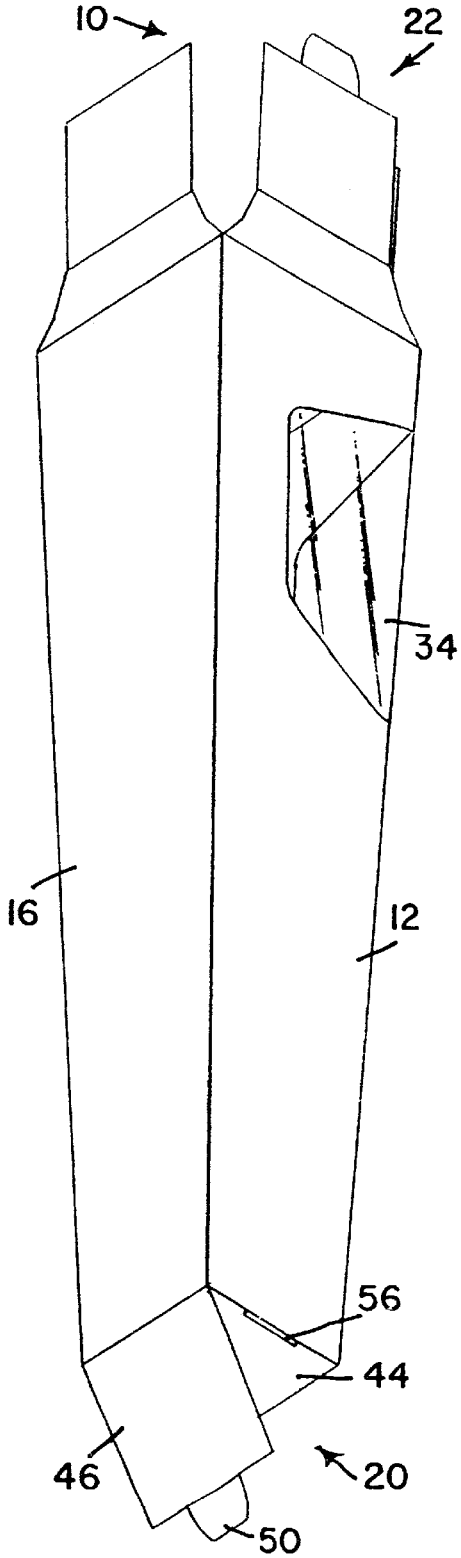
Figure 21:
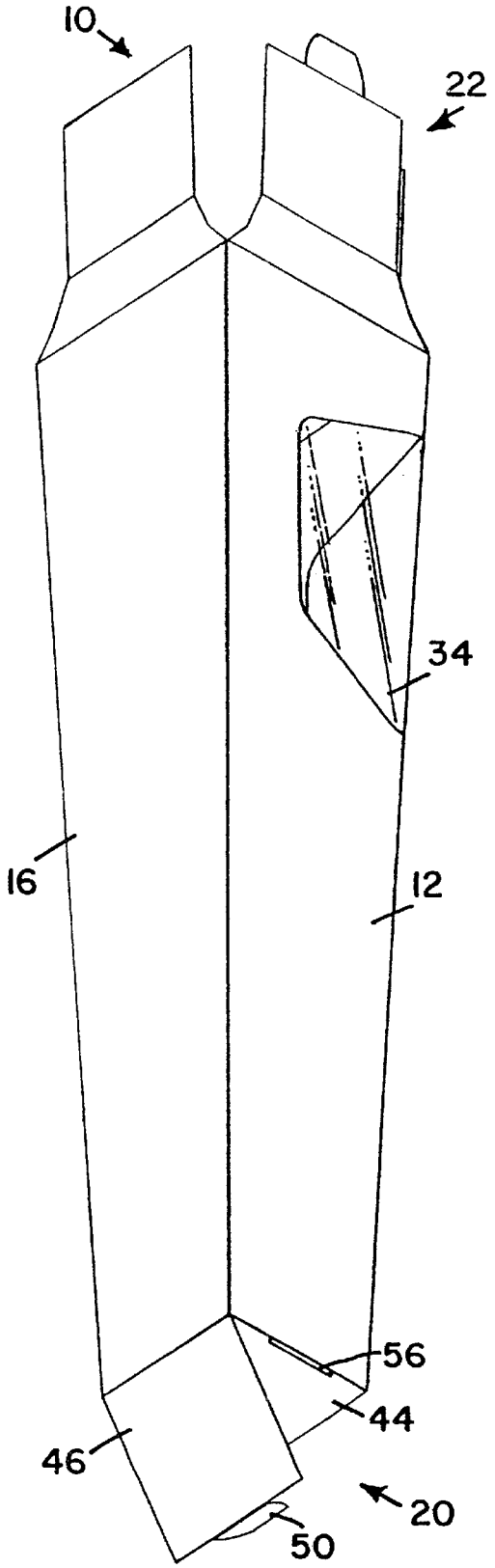
Figure 22:
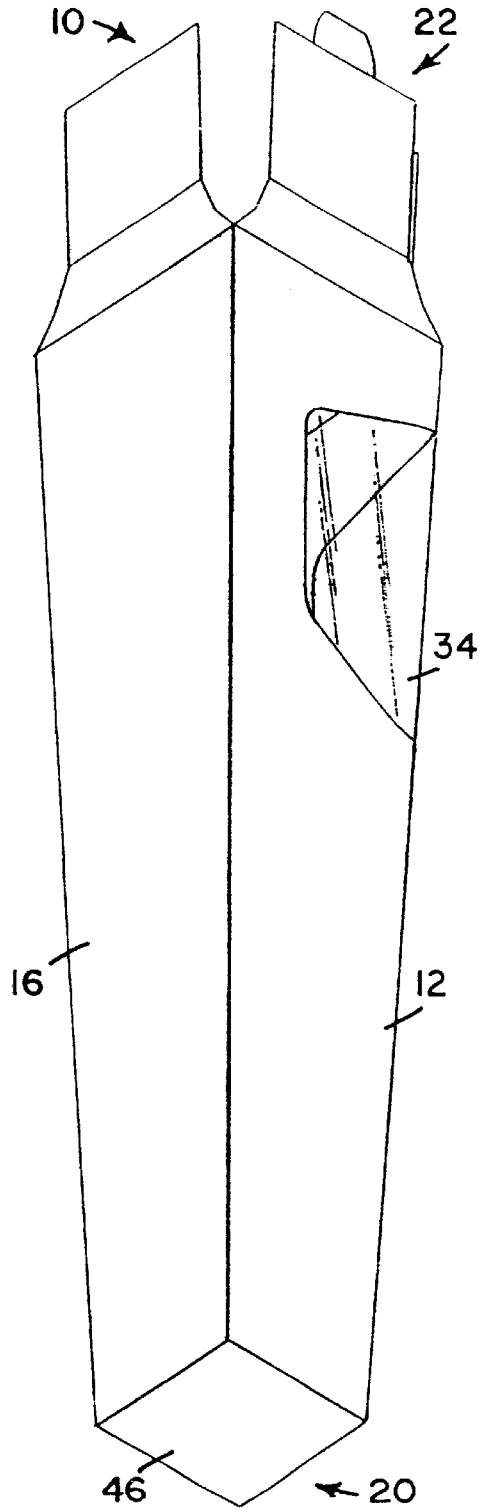

Referring to FIGS. 18 and 19, flap 44 is folded inwardly so that it lies beneath flap 46. Flap 46 is then folded inwardly, as shown in FIG. 20, and tab 50 is folded inwardly at a 90° angle relative to flap 46, as shown in FIG. 21. Tab 50 is inserted into slot 54 so that flap 44 lies beneath flap 46, as shown in FIG. 22, to complete the assembly of the bottom wall 20. When the bottom flaps are folded in, the recesses 56 are aligned with the tabs 48 and 50 to provide clearance for the tabs and to prevent the edges of the flaps on which the recesses appear from interfering with the insertion of the tabs. The tapering of the sides of flaps 46 and 44 also prevent interference to insertion of the tabs into the corresponding slots 52 and 54. Tabs 48 and 50 are so called locking tabs. Each tab 48 and 50 has a slit at each end of the tab that is offset slightly from the fold line of the tab. Likewise, each slot 52 and 54 has an extended portion at each end of the slot that is offset slightly from the main line of the slot. Each slot extension forms a bottom ledge which catches the end portion of the corresponding tab which is aligned with the slit and the tab. This prevents the bottom flaps from being opened once the tabs 48 and 50 are inserted into slots 52 and 54, respectively and ensures that the bottom wall of the floral container 10 remains closed when the floral container is used to transport a bouquet of cut flowers. In addition, when the floral container 10 with a bouquet of flowers therein is carried, the container is cradled in the carriers arm so that the aperture 32 faces upwardly and outwardly. In this position, the bottom edges of walls 16 and 18 face downwardly and the bottom edges of walls 12 and 14 which contain the slots 52 and 54 face upwardly. When the container 10 is held in its normal carrying position, such moisture will normally gravitate towards the bottom edges of walls 16 and 18. Since the seams which are formed between flap 42 and wall 18 and between flap 46 and wall 16 are unperiforated, they form a barrier against leakage from moisture emanating from the cut flowers.

Figure 23:
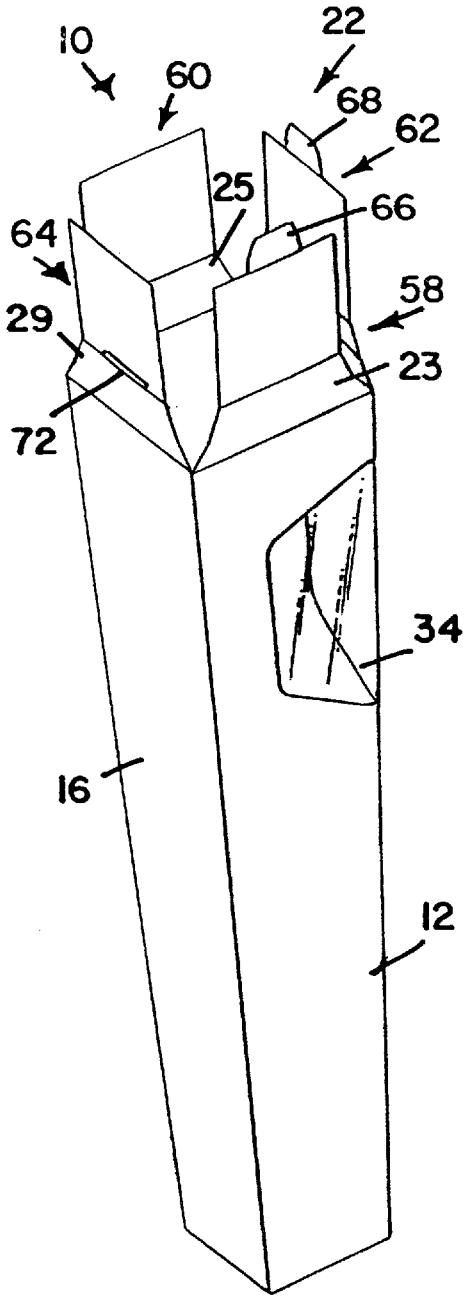
FIGS. 23–30 are operational views showing how the top flaps are folded to form an openable cover for the floral container.
Figure 24:
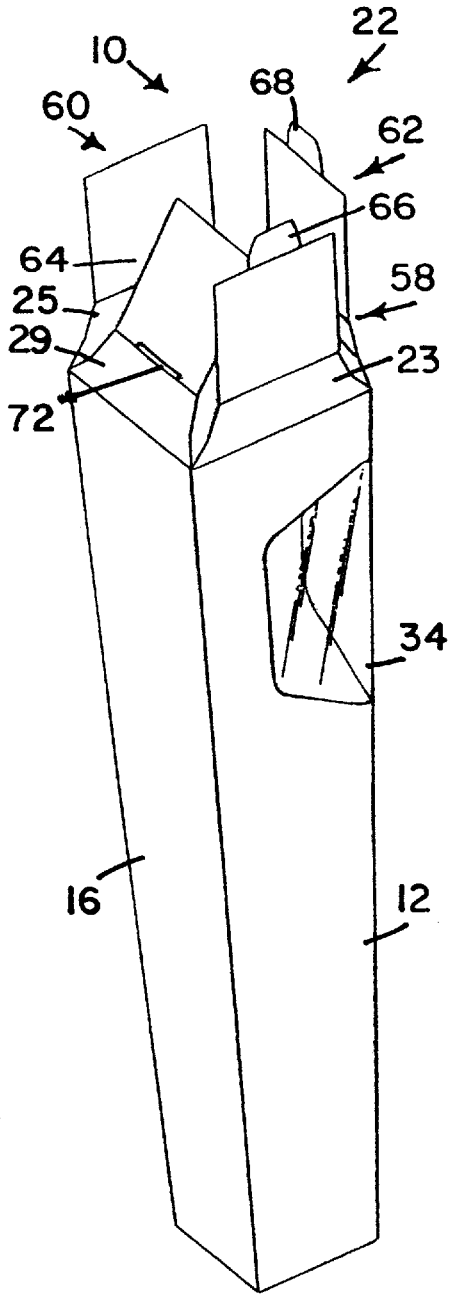
Figure 25:
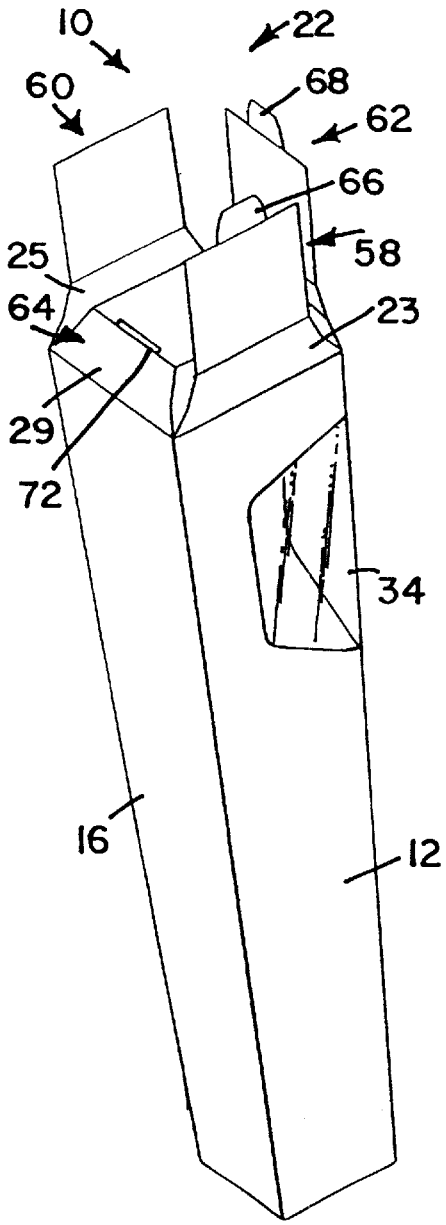

After a bouquet of flowers has been inserted into the container 10, the openable top closer 22 can be closed. Referring first to FIGS. 23–24, the fourth flap 64 is folded inwardly from the top edge of wall 16, as shown in FIG. 24, and its outer portion 65 is folded downwardly relative to its inner portion to form the lower portion 29, as shown in FIG. 25, so that the outer portion 65 of flap 64 lies horizontally and lower portion 29 extends at an angle to wall 16 and the outer portion 65 of flap 64.

Figure 26:
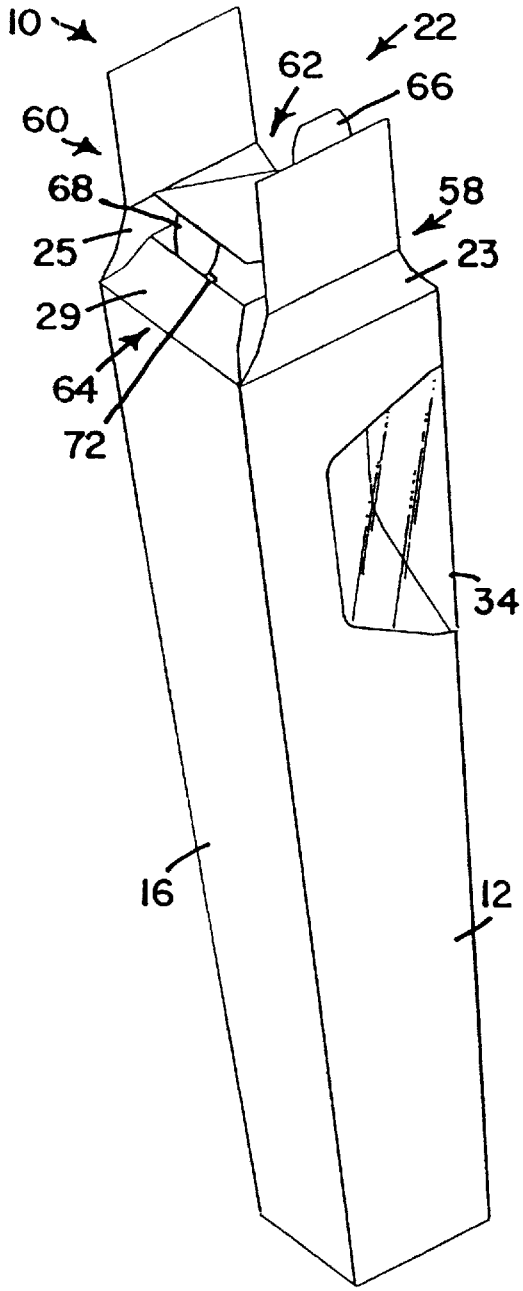
Figure 27:
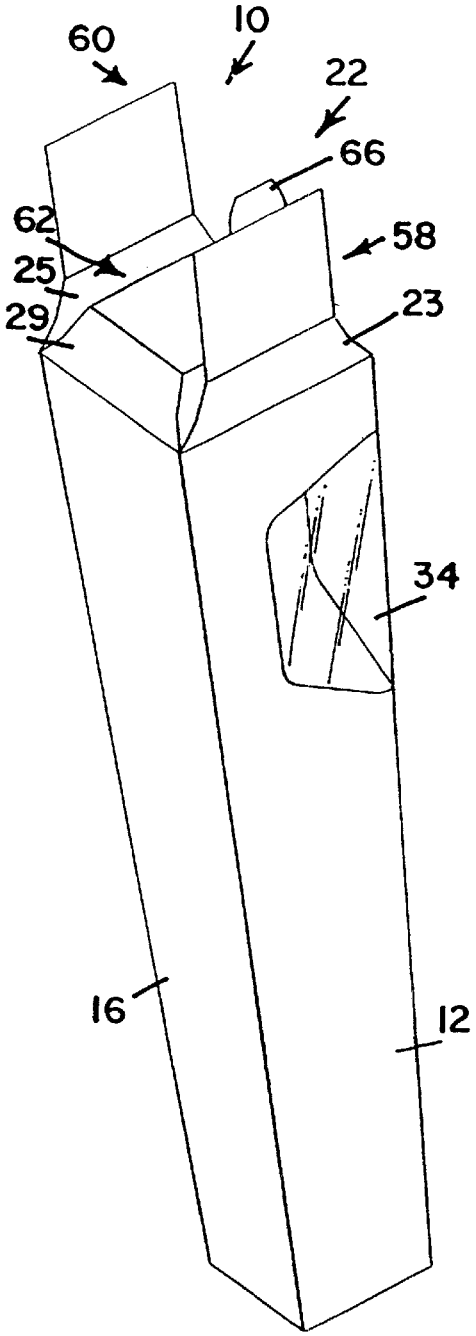

Referring to FIGS. 26 and 27, third upper flap 62 is folded inwardly and its outer portion 65 folded downwardly relative to its inner portion to form the third lower portion 27 while inserting tab 68 into slot 72, as shown in FIG. 26, so that the outer portion 65 of flap 62 lies on top of the outer portion of flap 64, as shown in FIG. 27.

Figure 28:
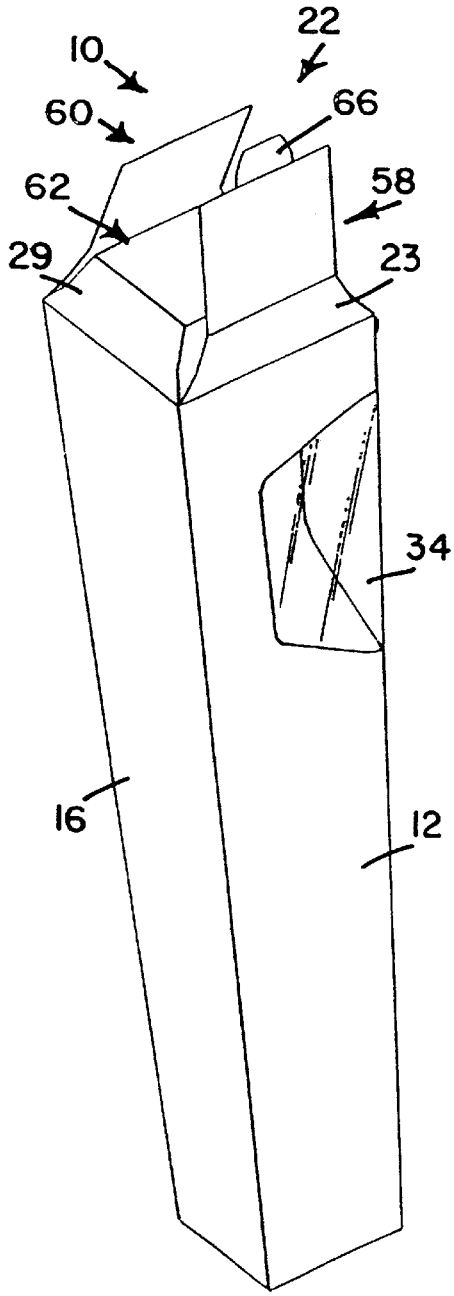
Figure 29:
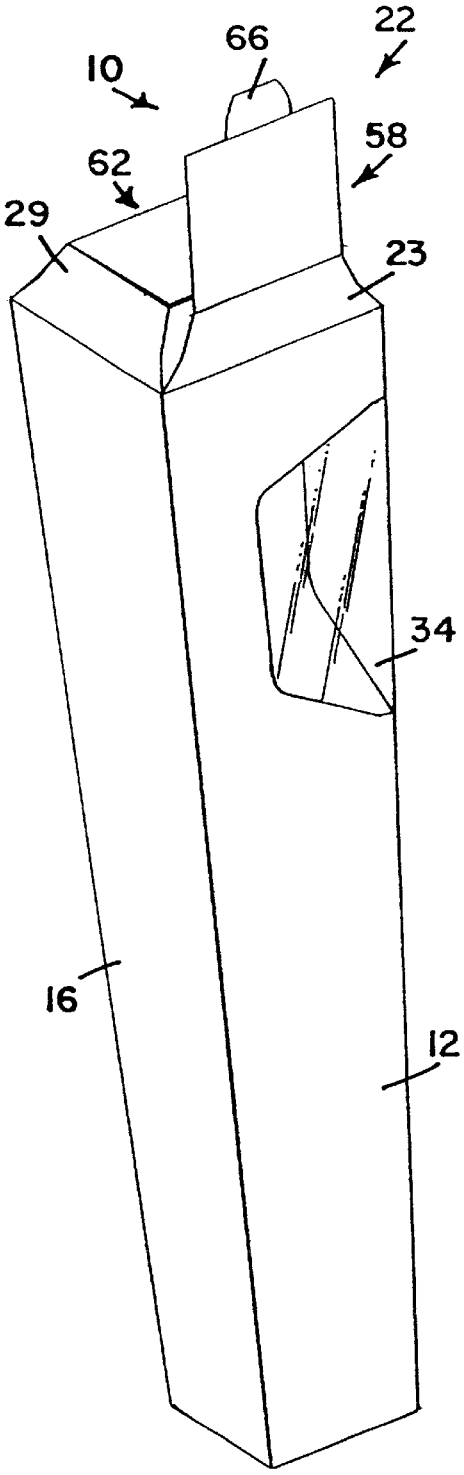
Figure 30:
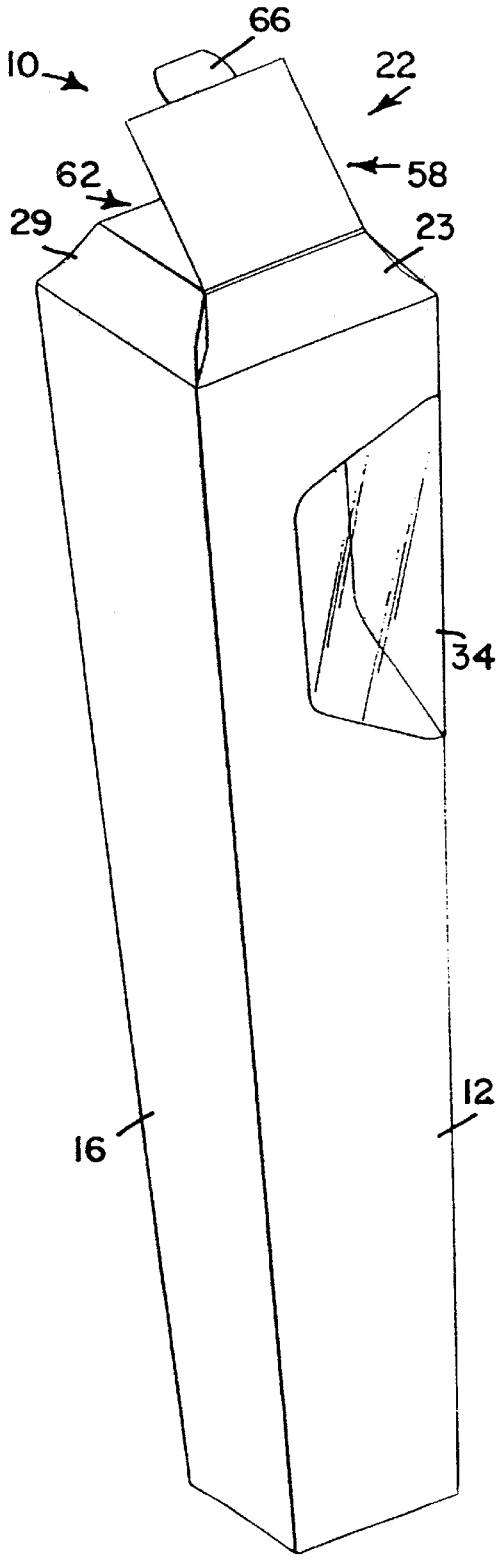
Figure 31:
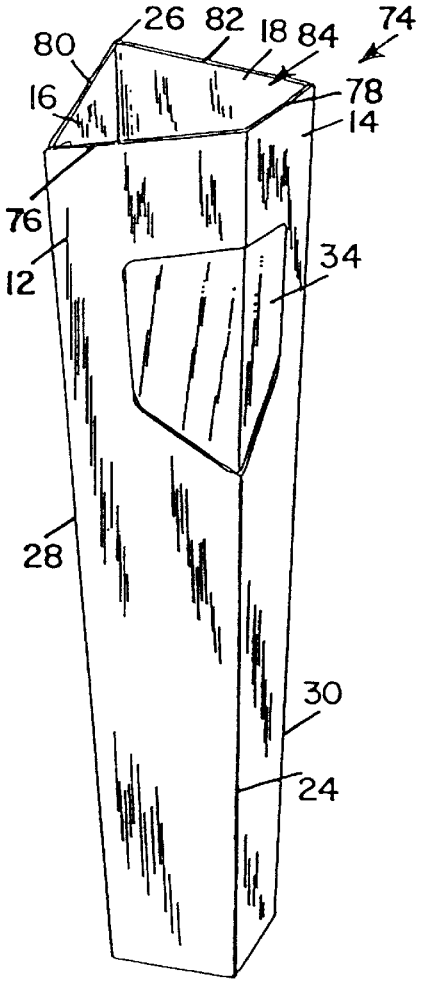
FIG. 31 is an isometric view of a modified floral container embodied the principles of the present invention.
Figure 32:
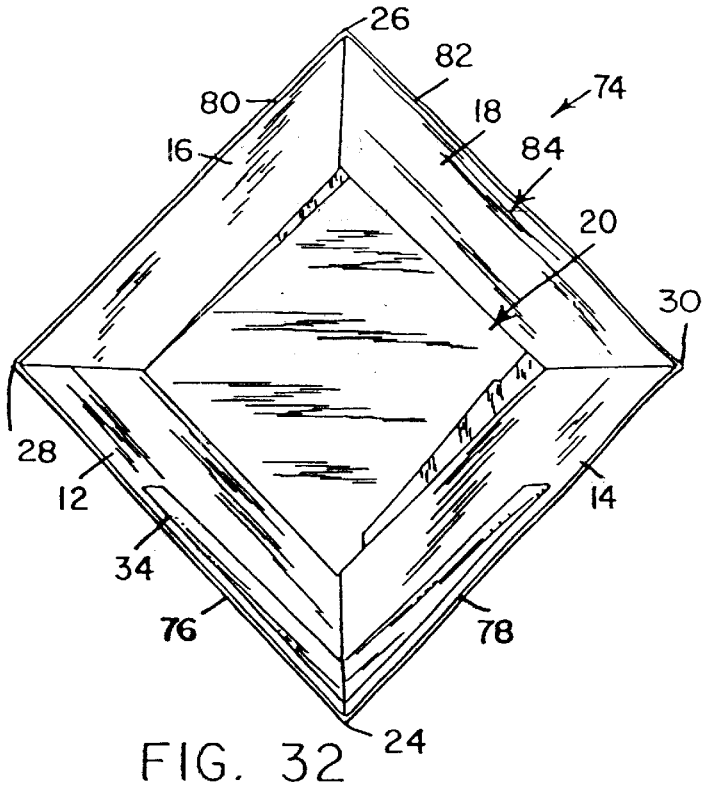
FIG. 32 is a top plan view thereof.
Figure 33:
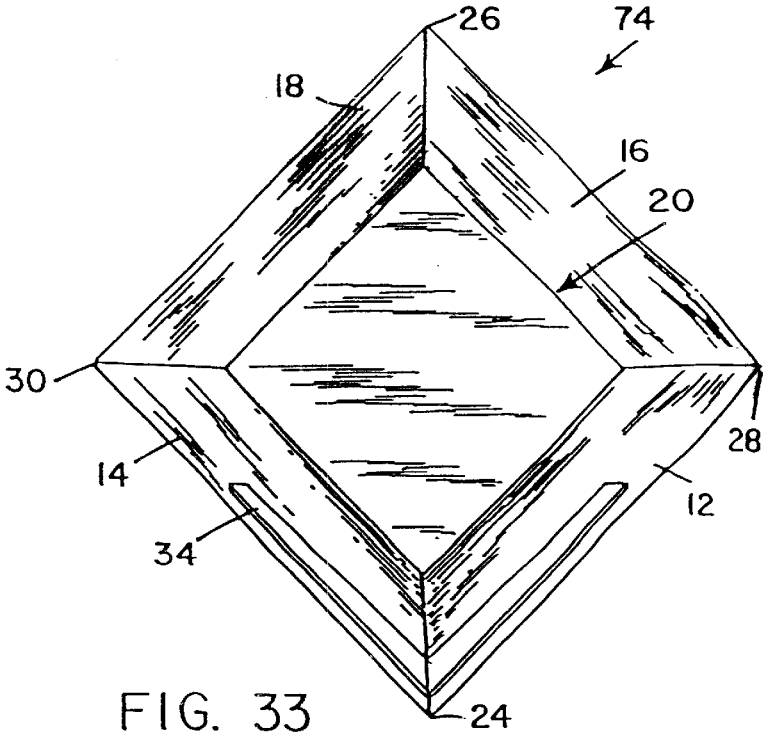
FIG. 33 is a bottom plan view thereof.
Figure 34:
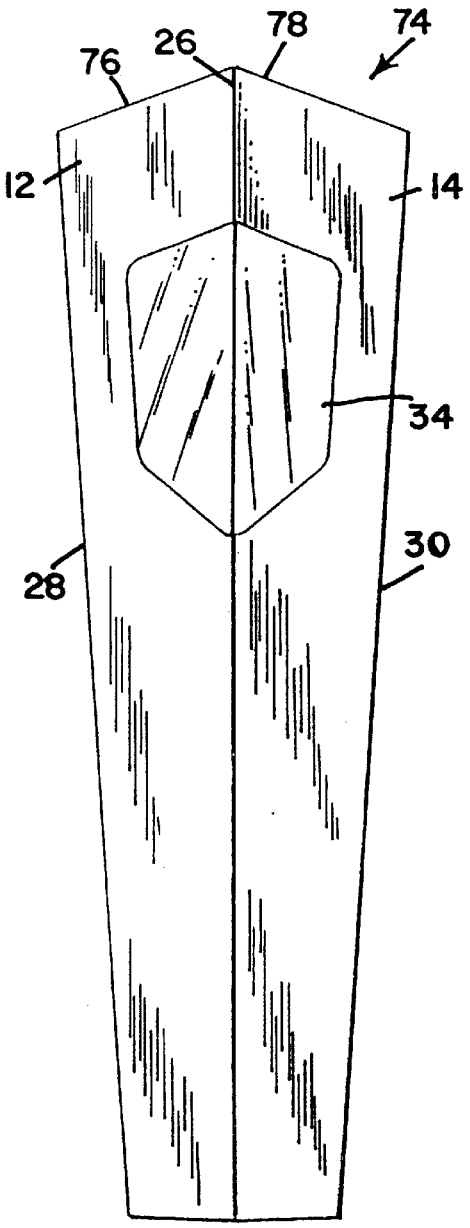
FIG. 34 is a front elevational view thereof.
Figure 35:
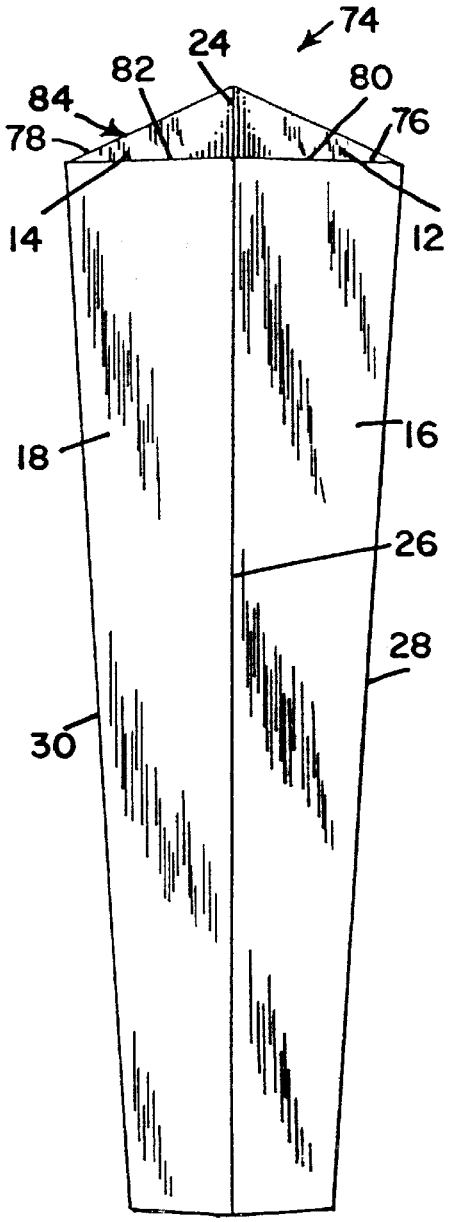
FIG. 35 is a rear elevational view thereof.

Referring to FIGS. 28 and 29, second upper flap 60 is folded inwardly and its outer portion 65 folded downwardly relative to its inner portion to form the second lower portion 25 so that the outer portion 65 of second upper flap 60 lies on top of the outer portion 65 of third upper flap 62, as shown in FIG. 29. The closing of the top closure 22 is completed by folding the first upper flap 58 inwardly, as shown in FIG. 30, and then folding the outer portion 65 of flap 58 downwardly relative to its inner portion to form the fourth lower portion 23 while also folding tab 66 inwardly at a 90° angle relative to the outer portion of the flap. This enables tab 66 to be inserted into slot 70. The outer portion 65 of flap 58 lies on top of the outer portion 65 of flap 60 to complete the closing of flower container 10.

The tapered shaped of the floral container 10 conforms to some extent to the natural shape of a bouquet of cut flowers and helps to maintain the upper floral portion of the bouquet centered behind opening 32 where it is visible.

Figure 36:
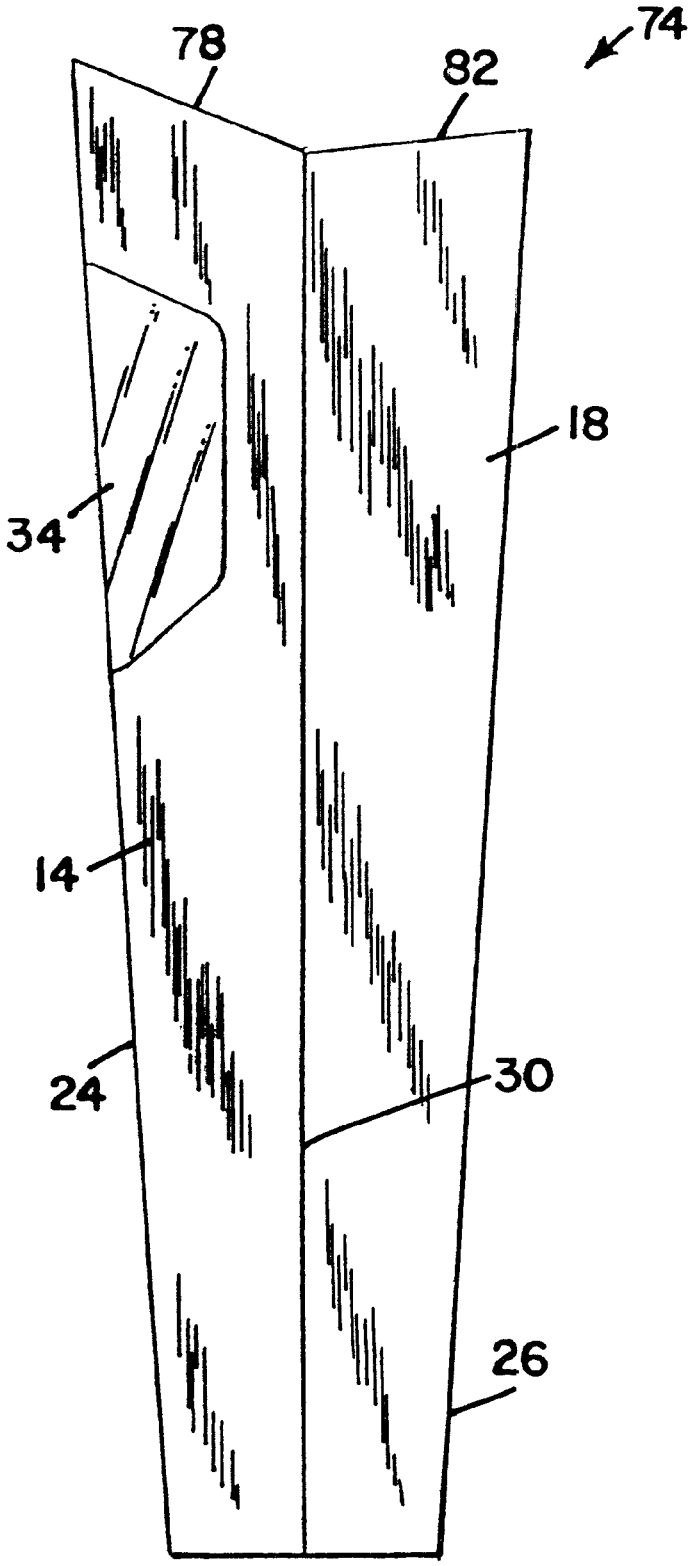
FIG. 36 is a right side elevational view thereof.
Figure 37:
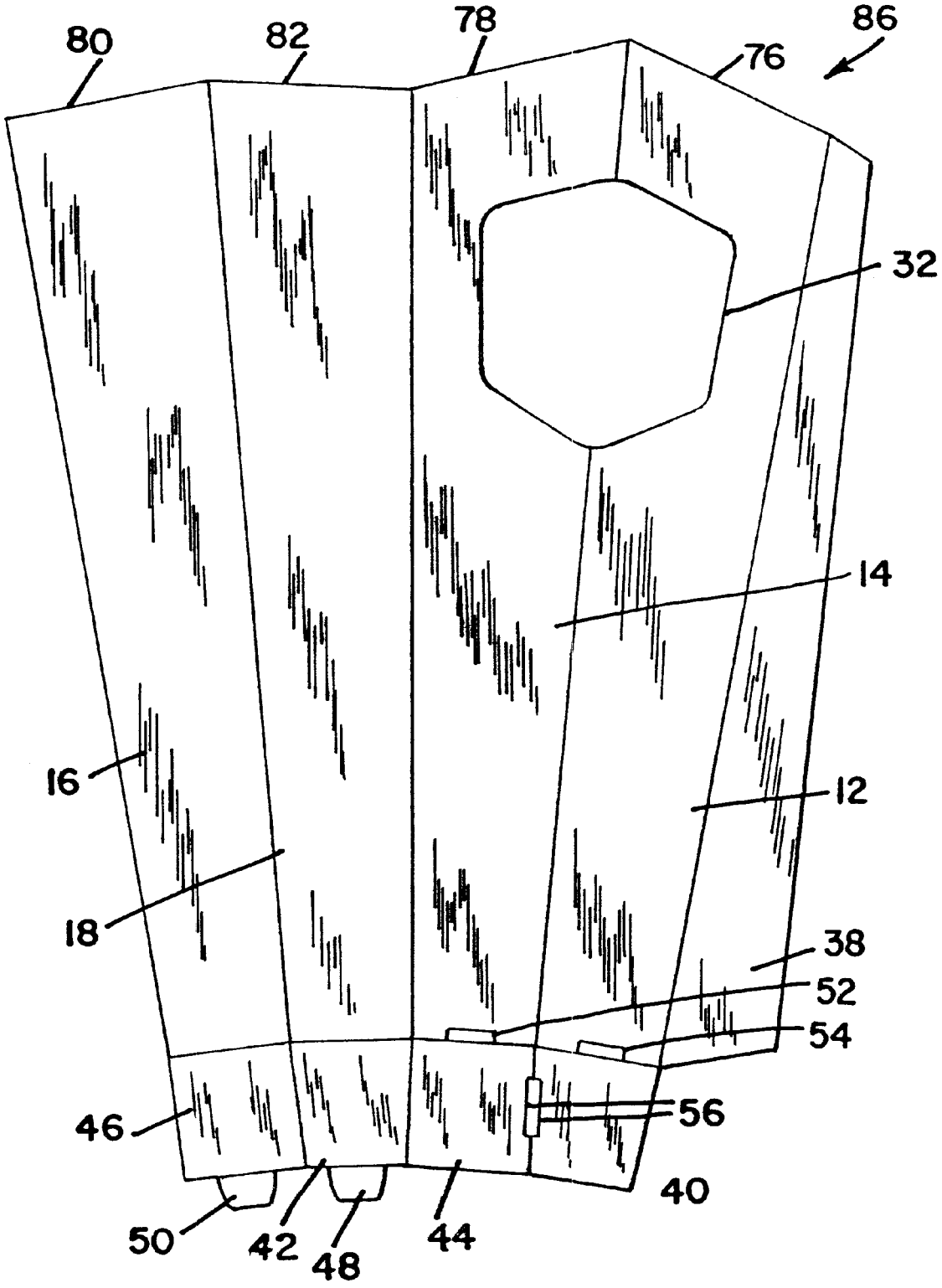
FIG. 37 is a diagram of a blank from which the modified embodiment of FIG. 31 is formed.

Referring to FIGS. 31–35, there is shown a second embodiment of the invention, generally indicated by the reference numeral 74. The embodiment 74 is identical to embodiment 10 except that embodiment 74 does not have the openable top closure 22. Wall 12 has a free upper edge 76. Wall 14 has a free upper edge 78. Wall 16 has a free upper edge 80 and wall 18 has a free upper edge 82. Edges 76, 78, 80, and 82 define a top opening 84. In addition, the front vertical edge 24 is higher than the rear vertical edge 26. Also, the rear vertical edge 26 is higher than each of the left vertical edge 28 and the right vertical edge 30. Therefore, edges 76 and 80 slope downwardly toward vertical edge 28 and edges 78 and 82 slope downwardly toward vertical edge 30. Since the forward vertical edge 24 is higher than the rearward vertical edge 26, the sloping angle of each of the edges 76 and 78 is greater than the sloping angle of edges 80 and 82. This is shown most clearly in FIGS. 35 and 36. The blank for forming forward floral container 74 is shown in FIG. 37 and is generally indicated by the reference numeral 86. Blank 86 is identical to blank 36 except that there are no upper flaps and the upper edges 76, 78, 80, and 82 extend at angles relative to the side walls 12, 14, 16, and 18. Blank 86 is assembled in the same manner as blank 36 to form the floral container 74.

Clearly minor changes can may be made in the form and construction of this invention without the departing from the material spirit thereof. Therefore, it is not desired to confine the invention to the exact form shown herein and described, but it is desired to include all subject matter that properly comes within the scoped claimed.

The invention having been thus described, what is claimed as new and desired to secure by Letters Patent is:

1. A floral container having an upper end and a lower end, said floral container being tapered from a relatively large horizontal cross section at said upper end to a relatively small horizontal cross section at said lower end and comprising;

(a) a forward vertical edge extending from said upper end to said lower end;

(b) a rearward vertical edge extending from said upper end to said lower end;

(c) a right vertical edge extending from said upper end to said lower end;

(d) a left vertical edge extending from said upper end to said lower end;

(e) a left forward side wall extending from said upper end to a first bottom edge at said lower end;

(f) a right rearward side wall extending from said upper end to a second bottom edge at said lower end, (g) a right forward side wall extending from said upper end to a third bottom edge at said lower end and joined to said left forward wall at said forward vertical edge and to said right rearward wall along said right vertical edge, a portion of at least one of said left forward wall and said right forward wall being transparent adjacent said upper end;

(h) a left rearward side wall extending from said upper end to a fourth bottom edge at said lower end and joined to said left forward wall along said left vertical edge and joined to said right rearward wall along said rearward vertical edge; and (i) a bottom wall connected to at least two of said bottom edges, said bottom wall comprising:

(1) a first flap having an outer end and an inner end hingedly connected to said first bottom edge, said first bottom edge having a first slot;

(2) a second flap pivotally connected to said second bottom edge which is opposite said first bottom edge;

(3) a first tab hingedly connected to the outer end of said second flap and extending into said first slot;

(4) a third flap hingedly connected to said third bottom edge, said third bottom edge having a second slot;

(5) a fourth flap having an outer end and an inner end hingedly connected to said fourth bottom edge which is opposite said third bottom edge; and (6) a second tab hingedly connected to the outer end of said fourth flap and extending into said second slot.

2. The floral container as recited in claim 1, wherein said second flap is below said first flap, said third flap is below said second flap and said fourth flap is below said third flap.

3. The floral container as recited in claim 1, wherein said first flap has a free end edge, said first flap having a gradually diminishing width towards said free end edge, said second flap having a gradually diminishing width toward said first tab.

4. The floral container as recited in claim 1, wherein said first flap has a first side edge which is recessed along a portion of said first side edge that is vertical aligned with second tab and, wherein said third tab has a second side edge which is recessed along a portion of said second side edge that is vertically aligned with said first tab.

5. A floral container having an upper end and a lower end, said floral container having a rectangular top opening at said upper end and being tapered from a relatively large horizontal cross section at said upper end to a relatively small horizontal cross section at said lower end, said floral container further comprising;

(a) a forward vertical edge extending from said upper end to said lower end;

(b) a rearward vertical edge extending from said upper end to said lower end;

(c) a right vertical edge extending from said upper end to said lower end;

(d) a left vertical edge extending from said upper end to said lower end;

(e) a left forward side wall having a first top edge and extending from said upper end to a first bottom edge at said lower end;

(f) a right rearward side wall having a second top edge and extending from said upper end to a second bottom edge at said lower end, (g) a right forward side wall having a third top edge and extending from said upper end to a third bottom edge at said lower end and joined to said left forward wall at said forward vertical edge and to said right rearward wall along said right vertical edge, a portion of at least one of said left forward wall and said right forward wall being transparent adjacent said upper end;

(h) a left rearward side wall having a fourth top edge and extending from said upper end to a fourth bottom edge at said lower end and joined to said left forward wall along said left vertical edge and joined to said right rearward wall along said rearward vertical edge;

(i) a bottom wall connected to at least two of said bottom edges; and (j) an openable top closure connected to the upper end of said floral container for closing said top opening, said openable top closure comprising:

(1) a horizontal rectangular upper portion spaced above said top edges, said upper portion having a first side edge, a second side edge, a third side edge and a fourth side edge, the horizontal dimensions of said upper portion being substantially smaller than the horizontal dimensions of said top opening;

(2) a first lower portion connected to said first side edge and to said first top edge;

(3) a second lower portion connected to said second side edge and to said second top edge;

(4) a third lower portion connected to said third side edge and to said third top edge;

(5) a fourth lower portion connected to said fourth side edge and to said fourth top edge, each of said lower portions sloping downwardly and outwardly from said upper portion; and (6) each of said lower portions having a pair of opposite end end edges, and each of said end edges being spaced from the end edge of an adjacent one of said lower portions so that an opening is formed above each of said vertical edges.

6. The floral container as recited in claim 5, wherein said openable top closure is formed by a first upper flap hingedly connected to said first top edge, a second upper flap hingedly connected to said second top edge, a third upper flap hingedly connected to said third top edge and a fourth upper flap hingedly connected to said fourth top edge, each of said upper flaps having an inner portion hingedly connected to the corresponding one of said top edges and an outer portion hingedly connected to the inner portion of the flap, the outer portions of said flaps being vertically aligned to constitute said horizontal top portion and said inner portions constituting the lower portions of said top closure.

7. The floral container as recited in claim 6, wherein said top closure further comprises:

(a) a first upper tab hingedly connected to the outer end of one of said upper flaps;

(b) a first slot between the inner portion and the outer portion of another one of said flaps that is opposite said one flap for receiving said first tab;

(c) a second tab hingedly connected to a further one of said flaps; and (d) a second slot between the inner portion and the outer portion of another one of said flaps that is opposite said further one of said flaps for receiving said second tab.

* * * * *